US005608190A

United States Patent [19]

Skowronski

[11] Patent Number: 5,608,190

[45] Date of Patent: Mar. 4, 1997

[54] STRAIN RELIEF ARRANGEMENT

[75] Inventor: Richard E. Skowronski, Elk Grove Village, Ill.

[73] Assignee: GTE Airfone Incorporated, Waltham, Mass.

[21] Appl. No.: 287,857

[22] Filed: Aug. 9, 1994

[51] Int. Cl.[6] ..... H01B 7/24

[52] U.S. Cl. ..... 174/135

[58] Field of Search ..... 174/135, 40 CC, 174/40 TD, 153 G, 65 R; 248/52; D8/356; D13/154; 439/449, 453, 455; 24/122.3, 122.6, 114.5, 129 A

[56] References Cited

U.S. PATENT DOCUMENTS

| | | | |
|---|---|---|---|
| 2,226,610 | 12/1940 | Heyman | 439/455 X |
| 2,275,800 | 3/1942 | Olson | 439/449 X |
| 2,555,292 | 5/1951 | Poupitch | 24/122.3 X |
| 3,991,446 | 11/1976 | Mooney et al. | 174/153 G X |
| 4,272,148 | 6/1981 | Knack, Jr. | 439/455 |
| 4,447,100 | 5/1984 | Dyce et al. | 439/449 X |
| 4,767,362 | 8/1988 | Moji | 439/449 X |
| 4,940,262 | 7/1990 | Baracat et al. | 439/445 X |

*Primary Examiner*—Kristine L. Kincaid
*Assistant Examiner*—Paramita Ghosh

[57] ABSTRACT

A strain relief arrangement includes a strain relief, a shield bead, a shrink tube, and an outer jacket. The strain relief includes a hub and a plurality of spokes extending outwardly from the hub. The hub forms a channel for permitting passage of one or more wires therethrough. The shield bead is disposed within the channel of the hub. The shrink tube is disposed adjacent to the strain relief. The outer jacket is composed of woven material and is braided over the shrink tube and over the hub of the strain relief with the plurality of spokes protruding through the braided outer jacket.

29 Claims, 3 Drawing Sheets

STRAIN RELIEF ARRANGEMENT

FIELD OF THE INVENTION

The present invention relates generally to arrangements for minimizing strain and stress applied to wires attached to electronic devices. More specifically, the present invention relates to a strain relief arrangement which is compact, flame-retardant, abrasion-resistant, and flexible.

BACKGROUND OF THE INVENTION

With respect to an electronic device having one or more wires attached therein, movement of the wires relative to the electronic device stresses the wires at the point of attachment within the electronic device. Various strain relief arrangements have heretofore been employed to reduce the stress and strain applied to these wires so as to prevent breakage of the wires. In typical strain relief arrangements, an outer jacket encases the wires and a strain relief, such as a metal or plastic collar, is bonded or crimped over the outer jacket. The strain relief is mounted to the electronic device to fix the longitudinal position (and possibly the rotational position) of the strain relief and the outer jacket relative to the electronic device. Any stresses or strains are therefore concentrated on the strain relief and the outer jacket, instead of on the wires.

A drawback of the foregoing strain relief arrangements is that bonding or crimping the strain relief over the outer jacket compromises the integrity of the outer jacket. Bonding or crimping the strain relief over the jacket weakens or possibly tears the outer jacket, which, in turn, reduces the effectiveness of the strain relief arrangement. Another drawback of some of these arrangements, especially those which bond the strain relief to the outer jacket, is that the outer jacket exhibits poor flame retardance, poor abrasion resistance, and/or poor flexibility. Yet another drawback of some of these strain relief arrangements is that they are bulky because the strain relief occupies a relatively large amount of space.

A need therefore exists for a strain relief arrangement which overcomes the aforementioned shortcomings associated with the above-types of strain relief arrangements.

SUMMARY OF THE INVENTION

In one particular embodiment, a strain relief arrangement comprises a strain relief and a flame-retardant braided outer jacket. The strain relief includes a hub and a plurality of spokes extending outwardly from the hub. The hub includes a central channel for permitting passage of one or more wires therethrough. In the preferred embodiment, the plurality of spokes includes four spokes circumferentially spaced approximately 90 degrees from each other about the hub. The outer jacket is braided over the hub of the strain relief. The plurality of spokes of the strain relief protrude through the braided outer jacket such that portions of the outer jacket are positioned between adjacent pairs of the plurality of spokes and the plurality of spokes are positioned external to the outer jacket.

To fix the longitudinal and rotational position of the strain relief arrangement relative to an electronic device, the strain relief is mounted within the housing of the electronic device adjacent to the point of entry of the outer jacket into the housing. The housing includes an aperture at the point of entry which is sufficiently large to accommodate the outer jacket, but is small enough to prevent passage therethrough of the strain relief. The interior of the housing adjacent to the point of entry preferably includes first and second opposing inner surfaces. The strain relief is positioned within the housing such that the outer edges of two adjacent spokes bear against or are in close proximity to the first inner surface and the outer edges of the remaining two adjacent spokes bear against or are in close proximity to the second inner surface. The close proximity of the inner surfaces of the housing to the spokes of the strain relief prevent the strain relief, and therefore the outer jacket and the wires within the outer jacket, from rotating relative to the electronic device.

Figure 1:
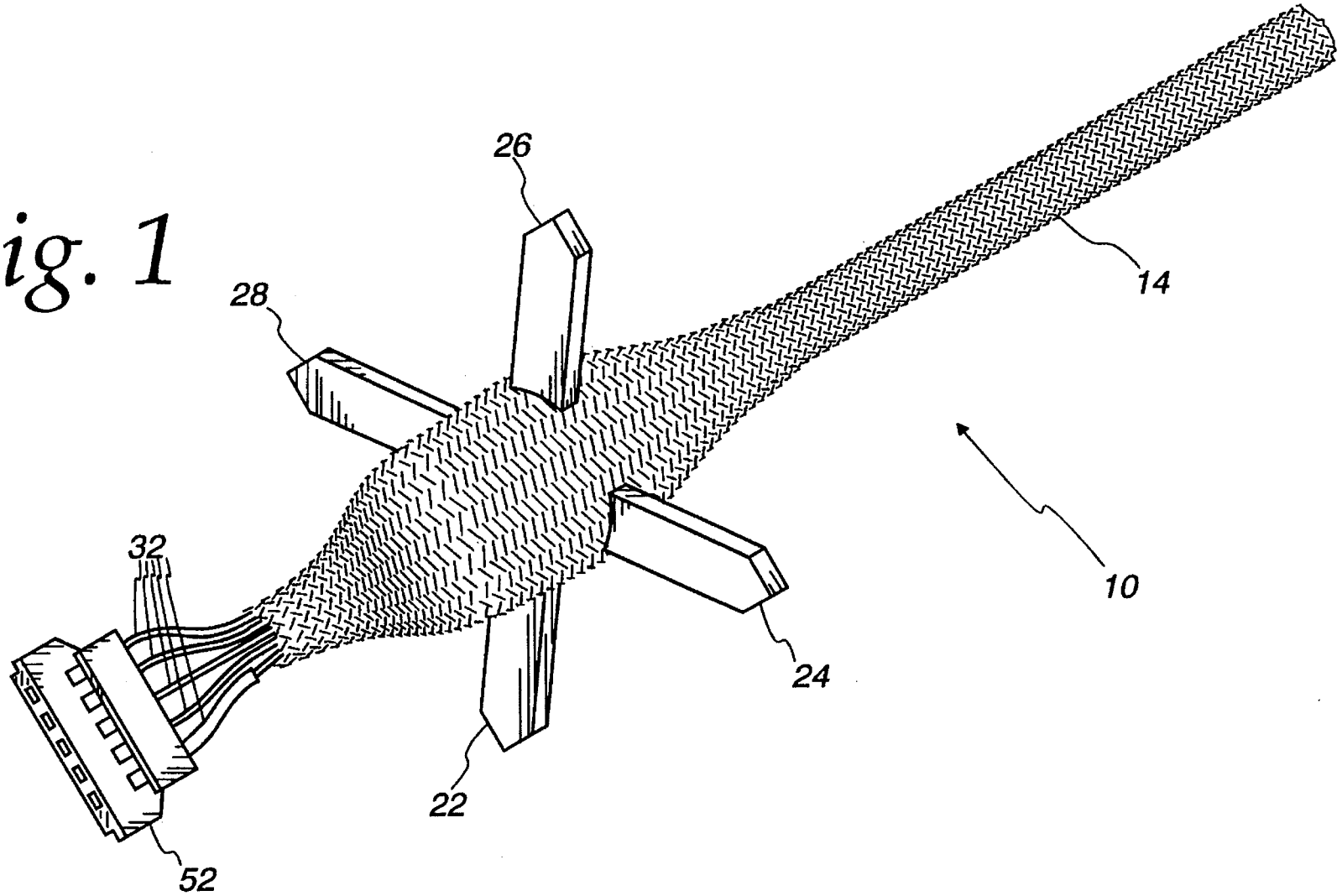
FIG. 1 is a perspective view of a strain relief arrangement embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
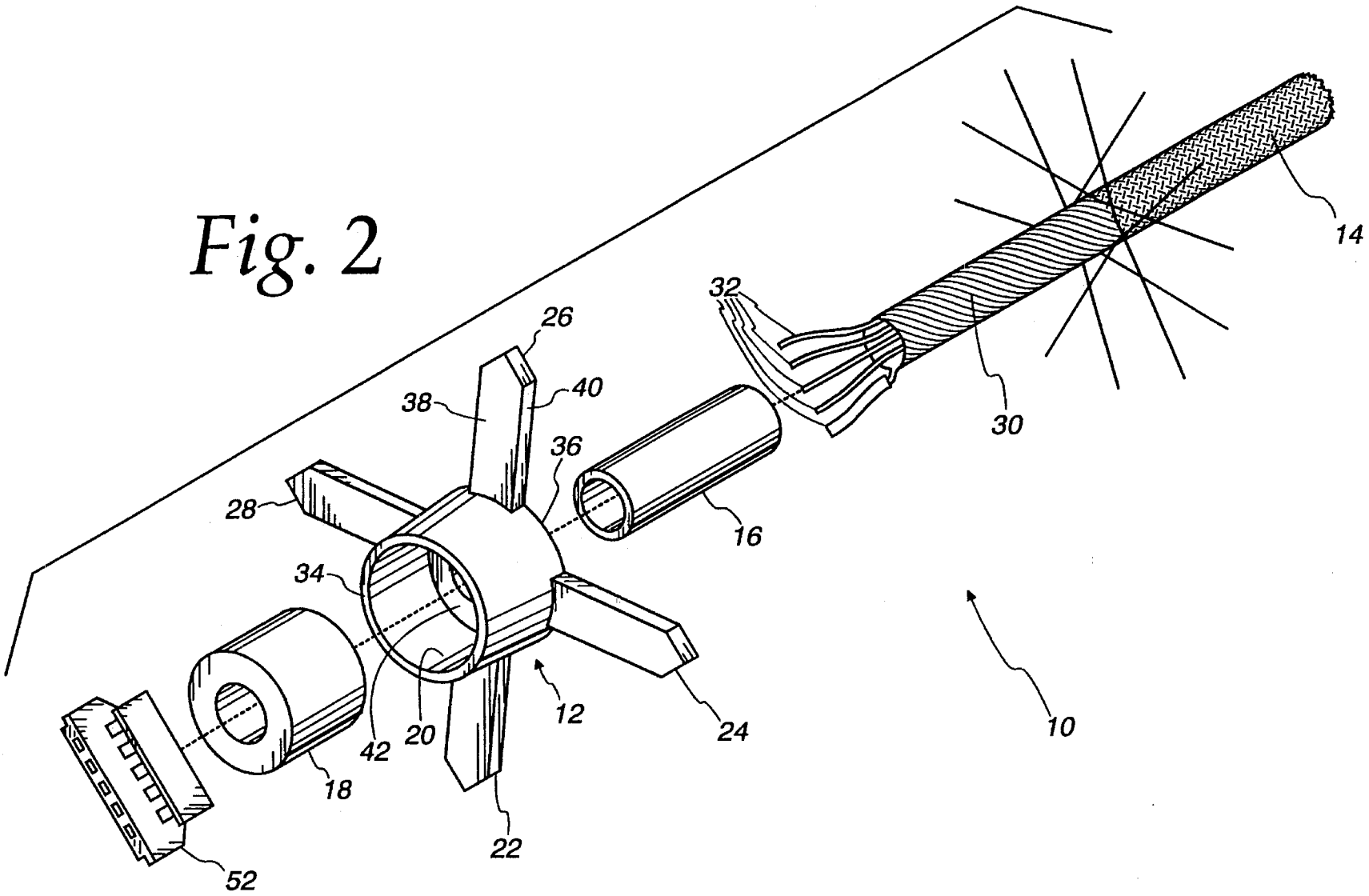
FIG. 2 is an exploded perspective view of the strain relief arrangement in FIG. 1.
Figure 3:
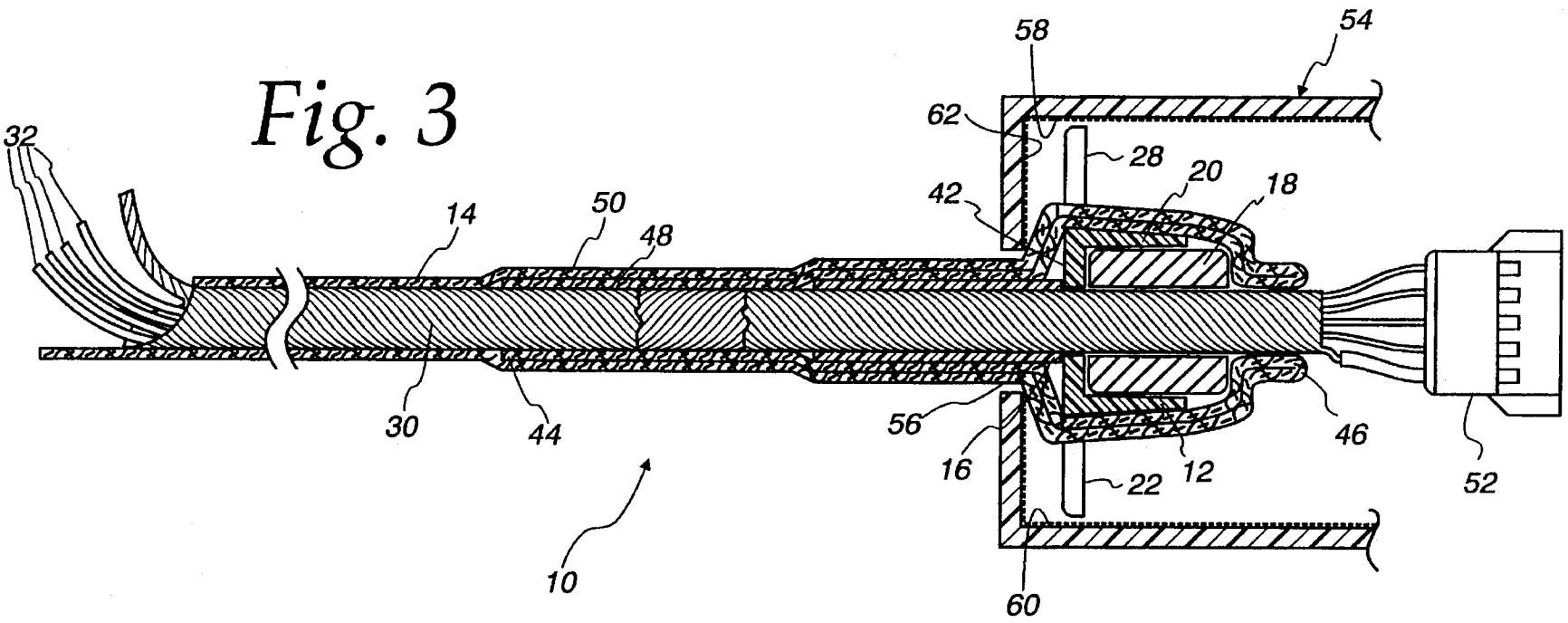
FIG. 3 is a cross-sectional view of the strain relief arrangement in FIG. 1.

Turning now to the drawings, FIGS. 1–3 illustrate a strain relief arrangement 10 including a strain relief 12, a braided outer jacket 14, a shrink tube 16, and a shield bead 18. The strain relief 12 includes a cylindrical hub 20 and a plurality of identical pointed spokes 22, 24, 26, and 28 integrally formed with and extending outwardly from the hub 20. As best shown in FIG. 3, the strain relief 12 and the shrink tube 16 are positioned adjacent to each other around an inner conductive jacket 30 which shields a plurality of wires 32. The shield bead 18 is disposed concentrically within the hub 20 of the strain relief 12. The outer jacket 14 is weaved over the hub 20 of the strain relief 12, and the plurality of spokes 22, 24, 26, and 28 of the strain relief 12 protrude through the braided outer jacket 14. The foregoing elements of the strain relief arrangement 10 are described in detail below.

The principal element of the strain relief arrangement 10 is the strain relief 12. As stated above, the strain relief 12 includes the hub 20 and the pointed spokes 22, 24, 26, and 28 surrounding the hub 20. Although the hub 20 preferably has a cylindrical configuration, the hub 20 may alternatively have a rectangular, triangular, or other suitable configuration. The cylindrical hub 20 has a proximal end 34 and a distal end 36, and the spokes are preferably located at the distal end 36 of the hub 20. The spokes 22, 24, 26, and 28 are circumferentially spaced approximately 90 degrees from each other around the hub 20. Therefore, the spokes 22, 26 are disposed in line with each other, and the spokes 24, 28 are disposed in line with each other. The spokes 22, 26 are perpendicular to the spokes 24, 28. In addition, the spokes 22, 24, 26, and 28 are perpendicular to the axis of the hub 20.

Each spoke of the strain relief 12 has a pointed triangular tip and a flat body. With respect to the axis of the hub 20, the wide side 38 of the flat spoke body is orthogonal to the hub axis while the narrow side 40 of the flat spoke body is parallel to the hub axis. In the preferred embodiment, the wide side 38 is approximately three times wider than the narrow side 40. Furthermore, the base of the wide side 38 extends around approximately one-eighth of the periphery of the hub. Therefore, since the base of each spoke covers approximately one-eighth of the hub periphery, the bases of the four spokes 22, 24, 26, and 28 encompass approximately one-half of the hub periphery. Since the spokes are regularly spaced about the hub periphery, the bases of adjacent spokes are spaced from each other by a peripheral distance corresponding to one-eighth of the hub periphery.

The strain relief 12 is preferably manufactured by conventional injection molding techniques. Also, the strain relief 12 is composed of a semi-flexible plastic material which permits the spokes 22, 24, 26, and 28 to bend several degrees toward the axis of the hub in response to the application of strain. In the preferred embodiment, the strain relief 12 is composed of ZYTEL™ ST-801 nylon commercially available from E. I. Du Pont de Nemours Co. of Wilmington, Delaware. Alternatively, the strain relief 12 may be composed of a metal material which is preferably insulated to prevent interference with circuitry in the electronic device associated with the strain relief arrangement 10 or with signals carried by the wires 32.

During the manufacture of the strain relief arrangement 10, the shrink tube 16 is first shrink fit over the inner conductive jacket 30 and the strain relief 12 is then telescoped over the conductive jacket 30 with its distal end 36 adjacent to the shrink tube 16 (FIGS. 2 and 3). The distal end 36 of the hub 20 preferably includes a bearing shoulder 42 having an innermost diameter less than the outer diameter of the shrink tube 16 so that the shoulder 42 bears against one end of the shrink tube 16, as opposed to sliding over the shrink tube 16.

After the strain relief 12 is slid over the conductive jacket 30 adjacent to the shrink tube 16, the shield bead 18 is telescoped over the conductive jacket 30 and mounted within the central channel formed by the hub 20 of the strain relief 12. To create an interference fit between the shield bead 18 and the hub 20, the outer diameter of the shield bead 18 is approximately equal to the inner diameter of the hub 20. Since the outer diameter of the shield bead 18 is accordingly greater than the innermost diameter of the shoulder 42 of the hub 20, the shield bead 18 is supported by the shoulder 42.

In an alternative embodiment, the innermost diameter of the shoulder 42 is slightly greater than the outer diameter of the shrink tube 16 so that the shrink tube 16 passes beneath the shoulder 42 and bears against the shield bead 18, instead of bearing against the shoulder 42. The inner diameter of the shield bead 18 is less than the outer diameter of the shrink tube 16.

The strain relief 12 and shield bead 18 are located within the housing of an electronic device adjacent to the point of entry of the outer jacket 14 into the housing. The shield bead 18 improves the EMI characteristics of the electronic device by changing the shield properties of the wires at this point of entry. In the preferred embodiment, the shield bead 18 is composed of ferrite and is commercially available as Part No. 2643250702 from Fair-Rite Products Corp. of Wallkill, N.Y.

After telescoping the shield bead 18 over the inner conductive jacket 30 and inserting the shield bead 18 into the hub 20 of the strain relief 12, the outer jacket 14 is braided over the inner conductive jacket 30, the shrink tube 16, and the strain relief 12 (with the shield bead 18 mounted therein). More specifically, the assembly of the conductive jacket 30, the shrink tube 16, and the strain relief 12 is loaded into a conventional braiding machine.

The braiding machine weaves outer jacket material over the assembly starting at a left longitudinal position 44 located to the left of the shrink tube 16 (as viewed in FIG. 3) and continuing to a right longitudinal position 46 located to the right of the shield bead 18 (as viewed in FIG. 3). Once the jacket material reaches this right longitudinal position 46 and has applied a first woven layer 48 of jacket material, the braiding machine reverses directions and applies a second layer 50 of jacket material over the first layer 48. Each time the braiding machine weaves jacket material over the strain relief 12, the spokes 22, 24, 26, and 28 of the strain relief 12 do not disrupt the weaving operation. Indeed, the pointed tips of the spokes cause the jacket material to fall on one side or the other of each spoke as the braiding machine applies the jacket material to the distal end 36 of the hub 20 (FIG. 1).

The portion of the arrangement 10 in close proximity to the strain relief 12 undergoes substantial abuse because it is this portion of the arrangement 10 which is located near the entry point of an electronic device. The second layer 50 of outer jacket material, as well as the shrink tube 16, stiffen and strengthen the arrangement 10 in this area of substantial abuse so as to provide greater strain and flex relief where it is desired.

The outer jacket 14 is preferably composed of a woven material which is flame-retardant, abrasion-resistant, flexible, tensile, and inexpensive. One suitable weaving material having the foregoing properties is conventional 6/6 nylon. Since the woven material is flexible, the portion of the arrangement having a single layer of woven material (i.e., the portion located to the left of the position 44 in FIG. 3) may be wound, for example, within a cord reel. At the same time, the double-layered portion of the arrangement provides greater strain and flex relief in an area which undergoes substantial abuse. Since the woven material is abrasion-resistant, the integrity of the outer jacket 14 is preserved and is not compromised over time. Therefore, the strain relief arrangement 10 provides consistent strain relief over time.

To fix the longitudinal and rotational position of the strain relief arrangement 10 relative to an electronic device, the strain relief arrangement 10 is mounted to the electronic device as follows. Referring to FIG. 3, the wires 32 passing through the strain relief arrangement 10 are attached to the circuitry within the electronic device using some type of connector 52. The strain relief 12 and the shield bead 18 are mounted within a housing 54 of the electronic device adjacent to the point at which the wires 32 and inner conductive jacket 30 enter the housing. The housing 54 includes an aperture at the point of entry which is sufficiently large to accommodate the outer jacket 14 at a position 56 to the left of the strain relief 12 (as viewed in FIG. 3), but is small enough to prevent passage therethrough of the strain relief 12.

When an individual pulls on the outer jacket 14 in a direction generally opposite to the housing 54, the strain relief 12 bears the load because the outer jacket 14 is effectively connected to the strain relief 12. As described above, the material of the outer jacket 14 is braided over the hub 20 of the strain relief as illustrated in FIG. 1. Pulling on the outer jacket 14 causes the strain relief 12 and the portion of the outer jacket 14 surrounding the strain relief 12 to press against the wall 62 of the housing 54. Similarly, when an individual pulls on the housing 54 in a direction generally opposite the strain relief arrangement 10, the strain relief 12 and the portion of the outer jacket 14 surrounding the strain relief 12 bear the load as they press against the housing wall 62.

The interior of the housing 54 adjacent to the point of entry preferably includes upper and lower opposing inner surfaces 58, 60. The strain relief 12 is positioned within the housing 54 such that the tips of the two adjacent spokes 26, 28 bear against or are in close proximity to the upper inner surface 58 and the tips of the remaining two adjacent spokes 22, 24 bear against or are in close proximity to the lower inner surface 60. The length of the spokes may be adjusted in accordance with the distance between the opposing inner surfaces 58, 60 of the housing 54. The close proximity of the inner surfaces 58, 60 of the housing 54 to the spokes of the strain relief 12 prevent the strain relief 12, and therefore the entire strain relief arrangement 10, from rotating relative to the electronic device.

The strain relief arrangement 10 provides effective strain relief using the compact strain relief 12. Compared to many typical strain reliefs, the strain relief 12 is relatively narrow in the axial direction. The width of the hub 20 is only about one-half centimeter. Since the strain relief 12 occupies a relatively small amount of space, only a small portion of the housing 54 in FIG. 3 must be dedicated to accommodating the strain relief 12.

It can be seen from the foregoing detailed description that the inner conductive shield 30 and the wires 32 do not carry loads and stresses which result from bending or pulling the outer jacket 14. Instead, the loads and stresses are borne by the strain relief 12 and the outer jacket 14. By keeping the loads and stresses off of the shield 30 and the wires 32, the lives of the shield 30 and the wires 32 are maximized. Thus, the strain relief arrangement 10 induces loads only on the strain relief 12 and the outer jacket 14, thereby preserving the shield 30 and the wires 32.

While the present invention has been described with reference to one or more particular embodiments, those skilled in the art will recognize that many changes may be made thereto without departing from the spirit and scope of the present invention.

For example, the strain relief 12 may be modified to include more or less than four spokes. If less than four spokes (e.g., one, two, or three spokes) are employed, the housing of the electronic device is preferably configured to minimize free rotation of the spokes so as to substantially fix the rotational position of the strain relief arrangement relative to the spokes.

Furthermore, it should be apparent that the shield bead 18 is not a necessary component of the strain relief arrangement 10. However, the channel formed by the hub 20 is a convenient location to mount the shield bead 18.

Each of these embodiments and obvious variations thereof is contemplated as falling within the spirit and scope of the claimed invention, which is set forth in the following claims.

What is claimed is:

1. A strain relief arrangement, comprising:

a strain relief including a hub and a plurality of spokes extending outwardly from said hub, said hub forming a channel for permitting passage of one or more wires therethrough; and an outer jacket composed of woven material and braided over said hub of said strain relief with said plurality of spokes protruding through said braided outer jacket.

2. The strain relief arrangement of claim 1, wherein said plurality of spokes includes four spokes circumferentially spaced approximately 90 degrees from each other around said hub.

3. The strain relief arrangement of claim 1, wherein each of said plurality of spokes includes a pointed tip.

4. The strain relief arrangement of claim 1, wherein each of said plurality of spokes is flat in shape.

5. The strain relief arrangement of claim 4, wherein each of said plurality of flat spokes has a wide side and a narrow side, an imaginary plane passing through said wide side being substantially orthogonal to an axis of said hub.

6. The strain relief arrangement of claim 1, wherein said hub is cylindrical in shape.

7. The strain relief arrangement of claim 6, further including a shield bead concentrically disposed within said channel of said hub.

8. The strain relief arrangement of claim 7, wherein said hub forms an inwardly-extending shoulder for supporting said shield bead, said shield bead having an outer diameter greater than an innermost diameter of said shoulder.

9. The strain relief arrangement of claim 1, further including a shrink tube disposed adjacent to said strain relief.

10. The strain relief arrangement of claim 9, wherein said shrink tube has an outer diameter greater than an innermost diameter of said hub.

11. The strain relief arrangement of claim 1, wherein said hub includes a proximal end and a distal end, said plurality of spokes extending from said distal end.

12. The strain relief arrangement of claim 1, wherein said woven material of said outer jacket is flame-retardant, abrasion-resistant, and flexible.

13. The strain relief arrangement of claim 12, wherein said woven material of said outer jacket is nylon.

14. The strain relief arrangement of claim 1, wherein said hub extends longitudinally between first and second ends, said plurality of spokes extending outwardly from said first end.

15. The strain relief arrangement of claim 1, wherein said strain relief is composed of nylon.

16. A strain relief arrangement, comprising:

a strain relief including a hub and a plurality of spokes extending outwardly from said hub, said hub forming a channel for permitting passage of one or more wires therethrough;

a shield bead disposed within said channel of said hub;

a shrink tube disposed adjacent to said strain relief; and an outer jacket composed of woven material and braided over said shrink tube and over said hub of said strain relief with said plurality of spokes protruding through said braided outer jacket.

17. The strain relief arrangement of claim 16, wherein said hub includes a proximal end and a distal end, said plurality of spokes extending outwardly from said distal end, said shrink tube being disposed adjacent to said distal end.

18. A strain relief affixed to an outer jacket containing a plurality of wires communicating with an electronic device, said strain relief mounted within a housing of said electronic device and inhibiting longitudinal and rotational movement of said plurality of wires relative to said electronic device, comprising:

a hub; and a plurality of spokes extending outwardly from said hub and engaging said housing.

19. The strain relief of claim 18, wherein said plurality of spokes includes four spokes circumferentially spaced approximately 90 degrees from each other around said hub.

20. The strain relief of claim 18, wherein each of said plurality of spokes includes a pointed tip.

21. The strain relief of claim 18, wherein each of said plurality of spokes is flat in shape.

22. The strain relief of claim 21, wherein each of said plurality of flat spokes has a wide side and a narrow side, an imaginary plane passing through said wide side being substantially orthogonal to an axis of said hub.

23. The strain relief of claim 18, wherein said hub is cylindrical in shape.

24. The strain relief of claim 18, wherein said hub forms an inwardly-extending shoulder.

25. The strain relief of claim 18, wherein said hub includes a proximal end and a distal end, said plurality of spokes extending from said distal end.

26. The strain relief of claim 18, wherein said hub extends longitudinally between first and second ends, said plurality of spokes extending outwardly from said first end.

27. The strain relief of claim 18, wherein said strain relief is composed of nylon.

28. A strain relief arrangement for use on a wire having braided material disposed therearound, comprising:

a hub; and a plurality of spokes extending outwardly from said hub, each of said plurality of spokes including a pointed tip directing said braided material to either side of said pointed tip.

29. A strain relief arrangement for use on an electrically conducting wire requiring electromagnetic shielding, comprising:

an electromagnetic shield having an outer diameter;

a hub forming an inwardly-extending shoulder with an inner diameter less than said outer diameter of said electromagnetic shield, a portion of said hub adjacent said inner diameter engaging said electromagnetic shield; and a plurality of spokes extending outwardly from said hub.

* * * * *